US009108096B2

(12) United States Patent
Solheim et al.

(10) Patent No.: US 9,108,096 B2
(45) Date of Patent: Aug. 18, 2015

(54) PORTABLE ELECTRONIC DEVICE HOLDERS AND METHODS TO MANUFACTURE PORTABLE ELECTRONIC DEVICE HOLDERS

(71) Applicant: KARSTEN MANUFACTURING CORPORATION, Phoenix, AZ (US)

(72) Inventors: John A. Solheim, Phoenix, AZ (US); Olly Eades, Loughborough (GB); Les Bryant, Phoenix, AZ (US); Martin Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/015,172

(22) Filed: Aug. 30, 2013

(65) Prior Publication Data

US 2015/0060618 A1 Mar. 5, 2015

(51) Int. Cl.
*A47B 96/00* (2006.01)
*A63B 69/36* (2006.01)

(52) U.S. Cl.
CPC ..... *A63B 69/3632* (2013.01)

(58) Field of Classification Search
CPC ..... F16B 2/12; F16M 13/02; F16L 3/26; A61M 5/1418; A61G 13/101; A63B 69/3632
USPC ..... 248/229.12, 229.22, 228.3, 230.3, 248/231.41, 924, 670, 346.07, 230.7, 248/231.81, 316.4, 72, 214, 218.4, 229.2, 248/448, 316.7, 316.1, 511, 518, 523, 540, 248/539, 541; 269/43, 143, 249; 29/276, 29/257; 473/223, 228, 226
See application file for complete search history.

(56) References Cited

U.S. PATENT DOCUMENTS

| | | | | |
|---|---|---|---|---|
| 2,653,330 | A * | 9/1953 | Nolan | 5/94 |
| 2,666,612 | A * | 1/1954 | Howell | 248/310 |
| 2,854,244 | A * | 9/1958 | Jarman | 280/47.26 |
| 2,945,657 | A * | 7/1960 | Jarman | 248/96 |
| 3,218,058 | A * | 11/1965 | Smith | 269/166 |
| 3,396,851 | A * | 8/1968 | Collins et al. | 211/85.8 |
| 4,126,290 | A * | 11/1978 | Drouillard | 248/231.41 |
| 4,300,742 | A * | 11/1981 | Hunn | 248/689 |
| 5,000,418 | A * | 3/1991 | Vogt | 248/689 |
| 5,911,635 | A | 6/1999 | Ogden | |
| 6,370,741 | B1 * | 4/2002 | Lu | 24/523 |
| 6,607,450 | B1 | 8/2003 | Hackman | |
| 6,959,899 | B2 | 11/2005 | Yeh | |
| 7,017,243 | B2 * | 3/2006 | Carnevali | 24/523 |
| 7,093,811 | B2 * | 8/2006 | Wu | 248/229.12 |
| 7,219,866 | B2 * | 5/2007 | Depay et al. | 248/229.22 |
| 7,551,458 | B2 * | 6/2009 | Carnevali | 361/807 |
| 7,686,267 | B2 * | 3/2010 | DaSilva | 248/229.12 |
| 7,837,166 | B2 * | 11/2010 | Liao et al. | 248/229.22 |
| D631,525 | S * | 1/2011 | Smith et al. | D22/108 |
| 8,083,198 | B2 * | 12/2011 | Stabler | 248/316.6 |
| 8,176,603 | B2 * | 5/2012 | Carnevali | 24/523 |
| 8,403,280 | B2 * | 3/2013 | Halverson et al. | 248/229.22 |
| 2010/0222152 | A1 | 9/2010 | Jaekel et al. | |
| 2011/0086720 | A1 | 4/2011 | Jaekel et al. | |
| 2011/0224012 | A1 | 9/2011 | Hashimoto et al. | |
| 2012/0257345 | A1 | 10/2012 | Hulet | |
| 2012/0257346 | A1 | 10/2012 | Hulet | |
| 2012/0286114 | A1 * | 11/2012 | Jertson et al. | 248/219.4 |
| 2012/0289354 | A1 | 11/2012 | Cottam et al. | |
| 2012/0322569 | A1 | 12/2012 | Cottam | |
| 2013/0032679 | A1 * | 2/2013 | Ward et al. | 248/229.11 |

* cited by examiner

*Primary Examiner* — Kimberly Wood

(57) ABSTRACT

Embodiments of portable electronic device holders and methods of manufacture of portable electronic device holders are generally described herein. Other embodiments may be described and claimed.

20 Claims, 7 Drawing Sheets

100

PORTABLE ELECTRONIC DEVICE HOLDERS AND METHODS TO MANUFACTURE PORTABLE ELECTRONIC DEVICE HOLDERS

FIELD

The present disclosure relates generally to sport accessories, and more particularly, to a portable electronic device holders and methods to manufacture portable electronic device holders.

BACKGROUND

In golf, some training devices may be an integral part of a golf club (i.e., built-in). That is, the golf club may not be readily used for play in a round of golf. Alternatively, other training devices may only function as a golf training device such that the training device may not be used for other purposes. Instead of the types of training device for golf mentioned above, individuals may use already-owned and/or everyday-used portable electronic devices as a training device for golf.

DESCRIPTION

In general, apparatus, methods, and articles of manufacture associated with a portable electronic device holder are described herein. The methods, apparatus, and articles of manufacture described herein are not limited in this regard.

Figure 5:
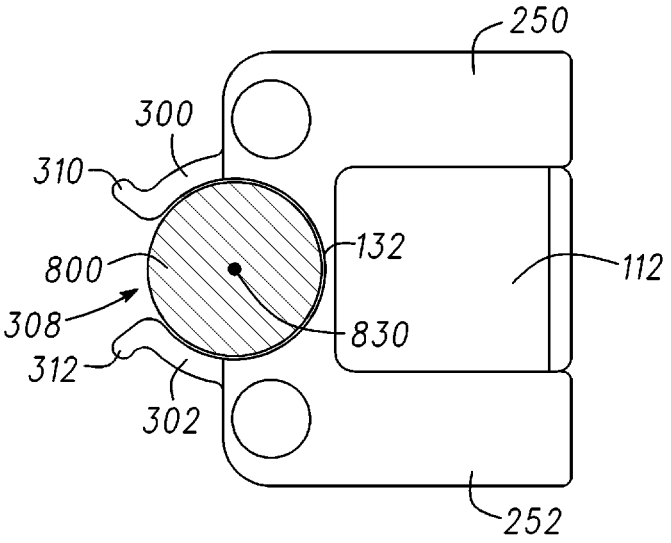
FIG. 5 shows a bottom view of the portable electronic device holder of FIG. 1.
Figure 6:
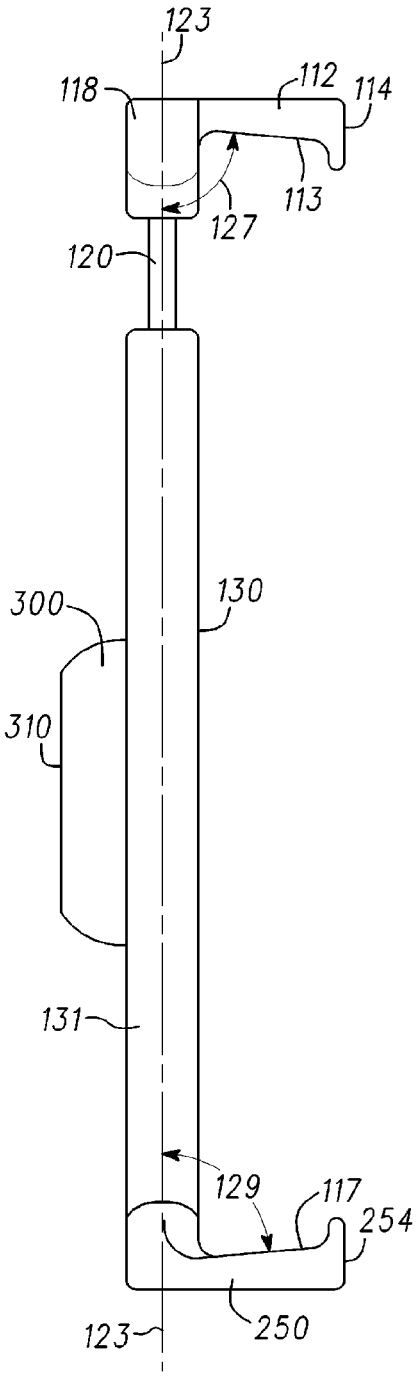
FIG. 6 shows a side view of the portable electronic device holder of FIG. 1.
Figure 7:
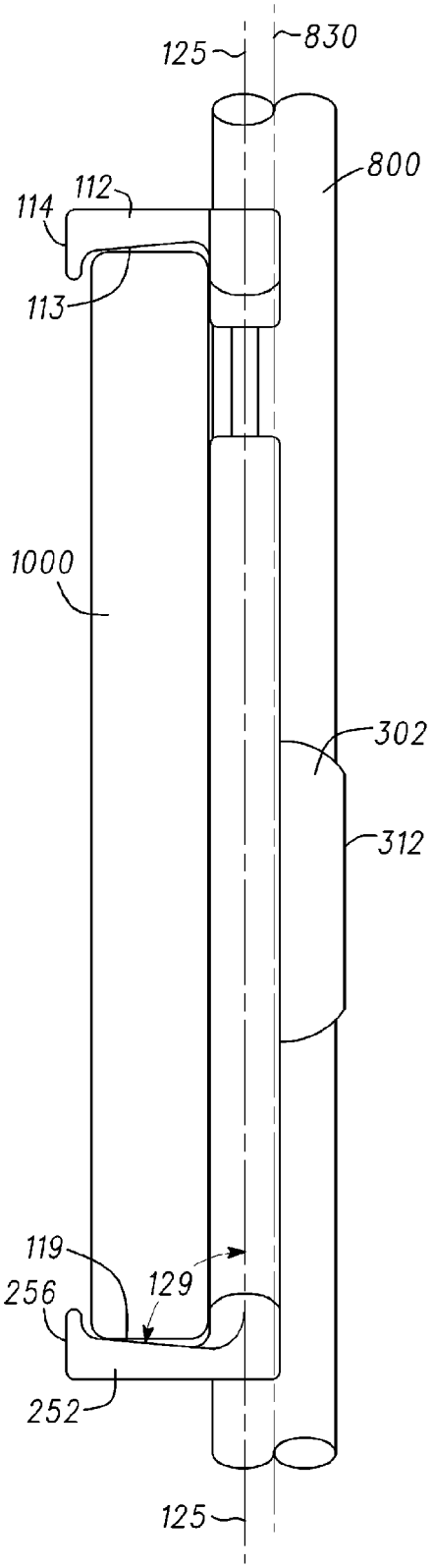
FIG. 7 shows another side view of the portable electronic device holder of FIG. 1 shown attached to a golf club shaft.
Figure 8:
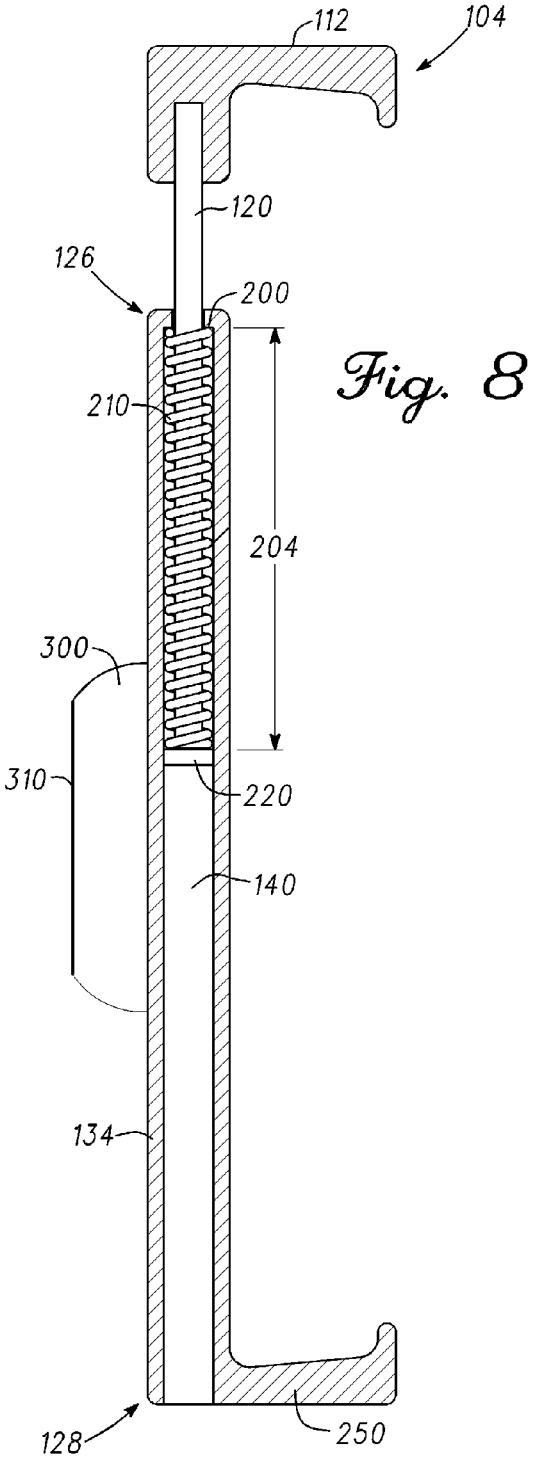
FIGS. 8 and 9 show side views of a section of the portable electronic device holder of FIG. 1.
Figure 9:
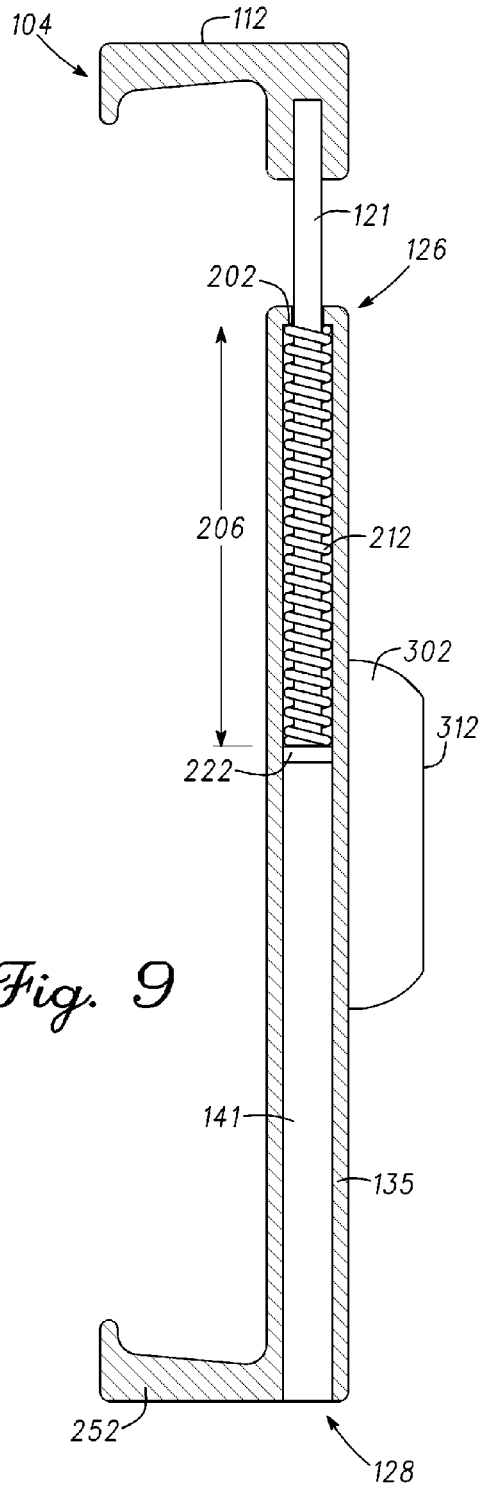
Figure 10:
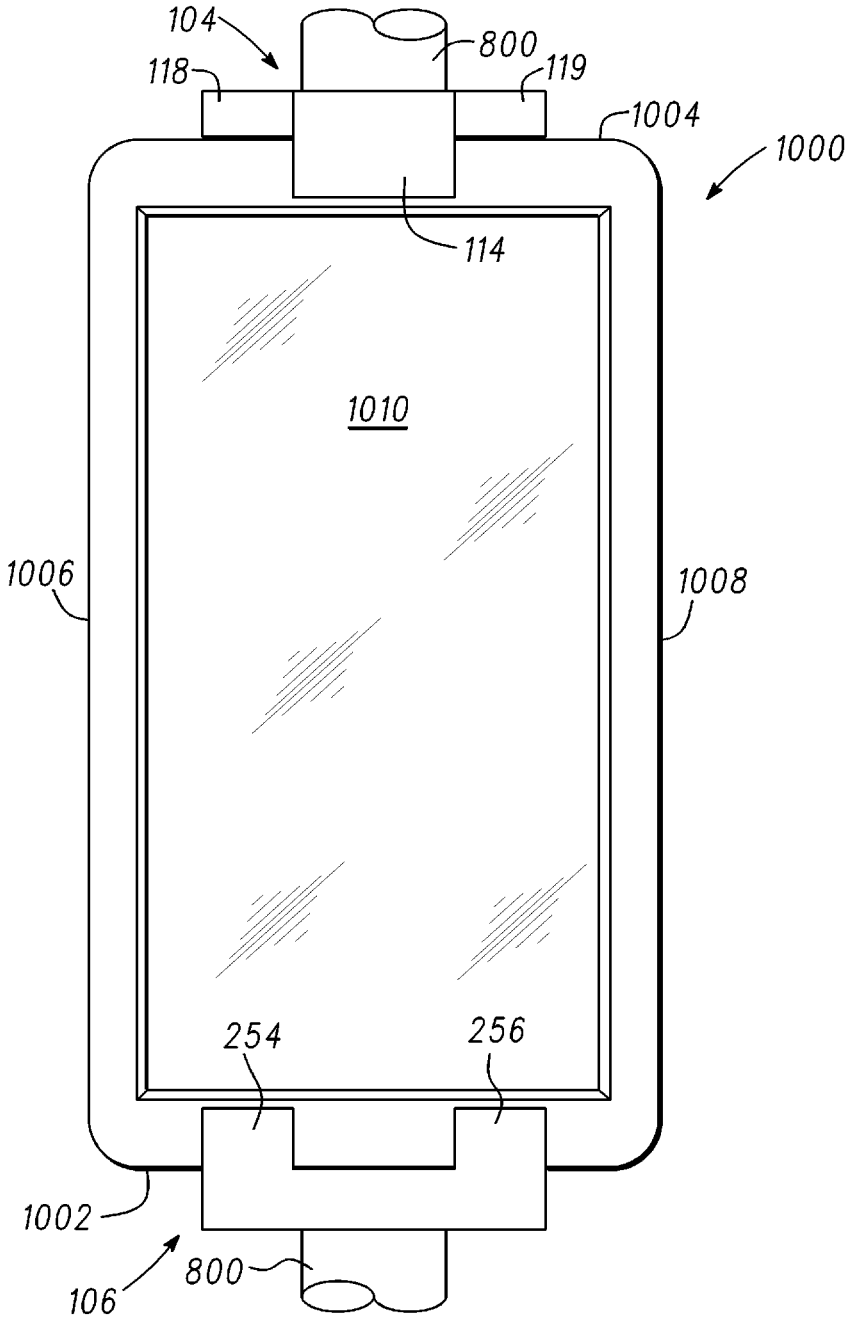
FIG. 10 shows a front view of the portable electronic device holder of FIG. 1 with an exemplary portable electronic device mounted on the portable electronic device holder.

In the example of FIGS. 1-10, a portable electronic device holder 100 may include a body portion 102, a first clamp portion 104 and a second clamp portion 106. As described in detail below, the portable electronic device holder 100 may be configured to removably attach a portable electronic device 1000 (generally shown in FIGS. 7 and 10) such as a wireless communication device and/or a portable media player to a golf club shaft 800 (generally shown in FIGS. 3-5, 7 and 10) of a golf club (e.g., a putter-type golf club). For example, the portable electronic device 1000 may be a media player (e.g., an IPOD® mobile digital device from Apple Inc., Cupertino, Calif.), a wireless telephone (e.g., an IPHONE® mobile digital device from Apple Inc., Cupertino, Calif.), a handheld or tablet computer (e.g., an IPAD® from Apple Inc., Cupertino, Calif.), a global positioning system (GPS) device, a game console device, a digital camera, a video camera, and/or any other electronic device that may be include any type of sensor (e.g., accelerometer, gyroscope, microphone, CCD imaging sensor, CMOS imaging sensor, etc.) for sensing and collecting data and/or images. The portable electronic device 1000 may be configured to operate as a training device (e.g., the portable electronic device 1000 may include a processor to execute a software application), such as a golf training device. In addition or alternatively, the portable electronic device 1000 may be configured to operate as a telephone or a speaker broadcasting music. As shown by the example of FIGS. 7 and 10, a portable electronic device 1000 may include a bottom portion 1002, a top portion 1004, a first side portion 1006, a second side portion 1008 that is opposite to the first side portion 1006, a display portion 1010 and a back portion 1012 (shown in FIG. 7). However, a portable electronic device may be in any shape such as oval, circular, triangular, spherical or other geometric and non-geometric shapes. Accordingly, a first clamp portion 104 and a second clamp portion 106 may be configured to provide engagement with any portable electronic device. The apparatus and articles of manufacture described herein are not limited in this regard.

Figure 1:
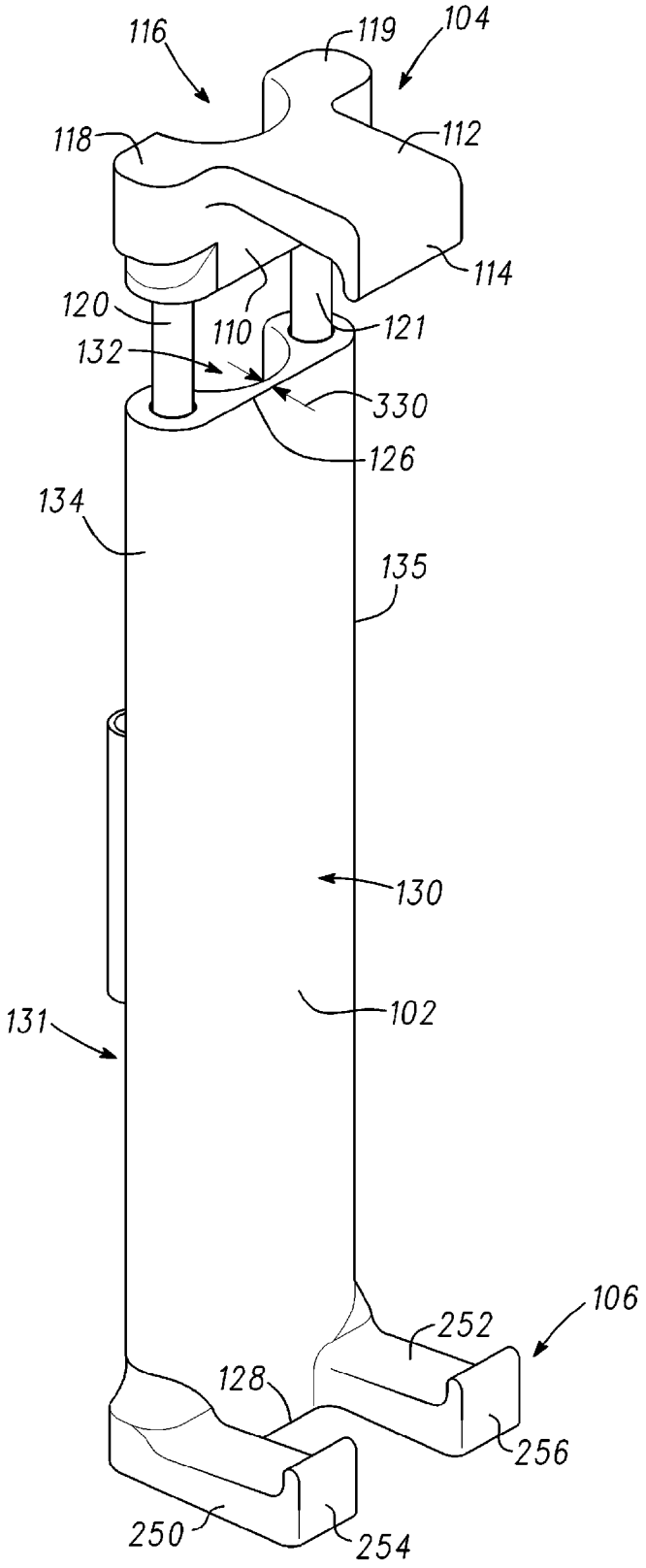
FIG. 1 shows a perspective view of a portable electronic device holder according to one embodiment.
Figure 2:
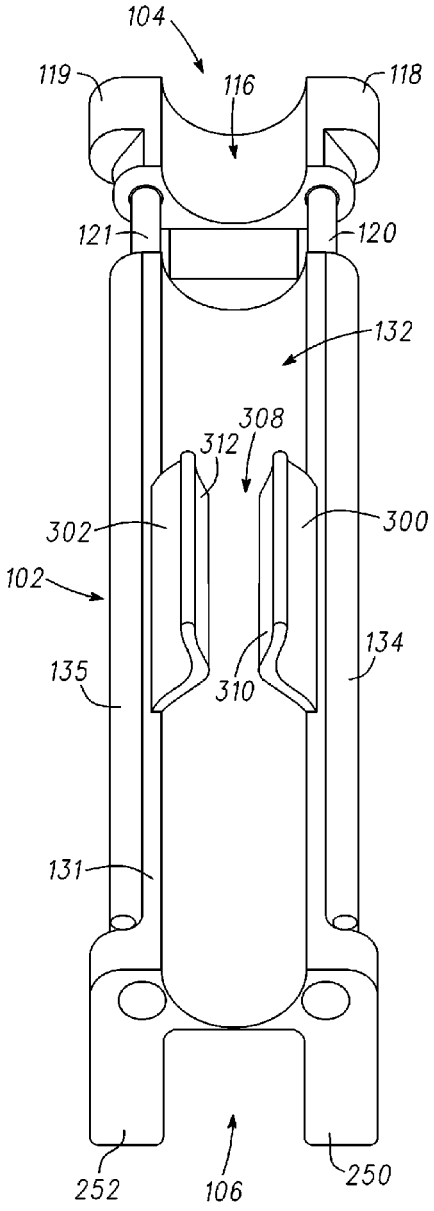
FIG. 2 shows a rear perspective view of the portable electronic device holder of FIG. 1.
Figure 3:
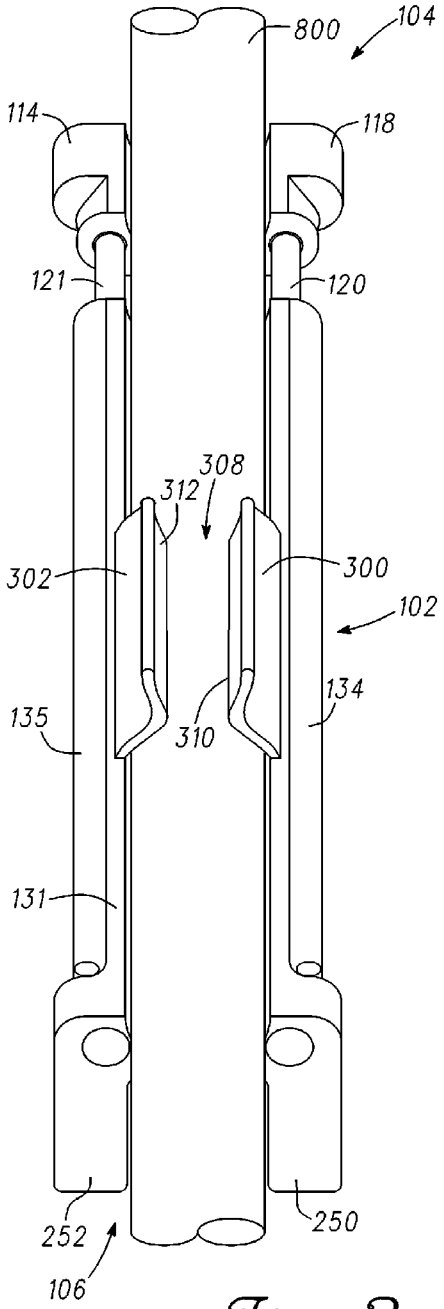
FIG. 3 shows a rear perspective view of the portable electronic device holder of FIG. 1 shown attached to a golf club shaft.

The first clamp portion 104 includes a first clamp body 110 and a first clamp arm 112 that is connected to the first clamp body 110 and extends transverse or generally perpendicular to the first clamp body 110. At the free end of the first clamp arm 112, the first clamp arm 112 includes a lip portion 114 extending generally transverse to the first clamp arm 112 and toward the second clamp portion 106. The first clamp body 110 includes a generally circular or curved channel 116 on a back side of the clamp body 110, which may be the side of the clamp body 110 that is opposite to the side of the first clamp body 110 to which the first clamp arm 112 is connected. The clamp body 110 includes a first rod attachment portion 118 and a second rod attachment portion 119, which may be located on opposite sides of the curved channel 116. A first rod 120 is attached to the first rod attachment portion 118 (shown in FIG. 8) and a second rod 121 is attached to the second rod attachment portion 119 (shown in FIG. 9). Accordingly, as shown in FIG. 1, two generally parallel and spaced apart rods 120 and 121 are attached to and extend from the first clamp body 110. The first rod 120 and the second rod 121 may be constructed with the clamp body 110 or constructed as separate pieces that are attached to the clamp body 110. For example, as shown in FIGS. 8 and 9, the first rod 120 and the second rod 121 may be separately constructed parts that are inserted into slots or bores of the first rod attachment portion 118 and the second rod attachment portion 119 and attached to the first rod attachment portion 118 and the second rod attachment portion 119, respectively. The first clamp portion 104 may include more than one clamp arm. For example the first clamp portion 104 may include a pair of spaced apart clamp arms (not shown). The methods, apparatus, and articles of manufacture described herein are not limited in this regard.

The body portion 102 includes a first end portion 126 and a second end portion 128. The first end portion 126 and the second end portion 128 may define a length of the body portion 102. The body portion 102 includes a front surface 130 that may extend from the first end portion 126 to the second end portion 128, and a generally curved channel 132 on a back portion 131, which is a portion of the body portion 102 that is behind the front surface 130. The body portion 102 further includes a first rod housing 134 and a second rod housing 135, which may be located on opposite sides of the curved channel 132 and extend along the length of the body portion 102. The first rod housing 134 includes a first rod passage 140 (shown in FIG. 8) that may be configured to accommodate a portion of the first rod 120 or the entire first rod 120. The second rod housing 135 includes a second rod passage 141 (shown in FIG. 9) that may be configured to accommodate a portion of second rod 121 or the entire second rod 121. Accordingly, the first clamp portion 104 may be movable from a position where the first clamp portion 104 abuts the body portion 102 and the first rod 120 and the second rod 121 are substantially inside the first rod passage 140 and the second rod passage 141, respectively, to a position where the first clamp portion 104 is spaced apart from the body portion 102 (shown for example in FIG. 1) and the first rod 120 and the second rod 121 are partially inside the first rod passage 140 and the second rod passage 141, respectively.

Referring to FIGS. 8 and 9, the first rod housing 134 includes a first aperture 200 at the first end portion 126. Portions of the first rod 120 may traverse in and out the first rod passage 140 through the first aperture 200. Similarly, the second rod housing 135 includes a second aperture 202 at the first end portion 126. Portions of the second rod 121 may traverse in and out of the second rod passage 141 through the second aperture 202. A diameter of each aperture 200 and 202 may be slightly greater than the outer diameter of the first rod 120 and the second rod 121, but is smaller than the inner diameter of the first rod passage 140 and the second rod passage 141, respectively. At a position along the first rod 120 or at the free end of the first rod 120, the first rod 120 includes a first stop 220, which may be cylindrical-shaped or disc-shaped. The stop 220 may have a diameter that is greater than the diameter of the first rod 120 and slightly smaller than the inner diameter of the first rod passage 140. Accordingly, a first annular passage 204 may be defined in the first rod passage 140 between the first stop 220 and the first aperture 200. Movement of the first rod 120 through the first rod passage 140 changes the length of the first annular passage 204. Similarly, at a position along the second rod 121 or at the free end of the second rod 121, the second rod 121 includes a second stop 222, which may be cylindrical-shaped or disc-shaped. The second stop 222 has a diameter that is greater than the diameter of the second rod 121 and slightly smaller than the inner diameter of the second rod passage 141. Accordingly, a second annular passage 206 may be defined in the second rod passage 141 between the second stop 222 and the second aperture 202. Movement of the second rod 121 through the second rod passage 141 changes the length of the second annular passage 206.

A first spring 210 is disposed in the first annular passage 204. The first spring 210 has a coil diameter that is smaller than the inner diameter of the first rod passage 140, greater than the diameter of the first aperture 200 and smaller than the diameter of the first stop 220. Accordingly, the first spring 210 is bound in the first annular passage 204. Similarly, a second spring 212 is disposed in the second annular passage 206. The second spring 212 has a coil diameter that is smaller than the inner diameter of the second passage 141, greater than the diameter of the second aperture 202 and smaller than the diameter of the second stop 222. Accordingly, the second spring 212 is bound inside the second annular passage 206.

Movement of the first rod 120 in the first rod passage 140 changes the length of the first annular passage 204. When the first rod 120 is moving in a direction out of the first rod passage 140, the first stop 220 compresses the first spring 210 against the first end portion 126 (i.e., around the first aperture 200) such that the first spring 210 exerts a force on the first stop 220 opposite to the movement of the first rod 120. When the first rod 120 is moving in a direction into the first rod passage 140, the first stop 220 allows the first spring 210 to decompress such that the force exerted by the spring on the first stop 220 is reduced.

Movement of the second rod 121 in the second rod passage 141 changes the length of the second annular passage 206. When the second rod 121 is moving in a direction out of the second rod passage 141, the second stop 222 compresses the second spring 212 against the first end portion 126 (i.e., around the second aperture 202) such that the second spring 212 exerts a force on the second stop 222 opposite to the movement of the second rod 121. When the second rod 121 is moving in a direction into the second rod passage 141, the second stop 222 allows the second spring 212 to decompress such that the force exerted by the spring on the second stop 222 is reduced.

The second clamp portion 106 (shown for example in FIGS. 1 and 2) includes a second clamp arm 250 and a third clamp arm 252 that may be spaced apart to collectively provide a sufficiently wide support for a portable electronic device such as the portable electronic device 1000. Each of the second clamp arm 250 and the third clamp arm 252 extends transversely from the body portion 102. The second clamp arm 250 may include a second lip portion 254 and the third clamp arm 252 may include a third lip portion 256. Each of the second lip portion 254 and the third lip portion 256 may extend toward the first clamp portion 104. The second clamp portion 106 may include a single clamp arm similar to the first clamp portion 104 or more than two clamp arms. Each clamp arm 250 and 252 may be fixed to the body portion 102 or be movable relative to the body portion 102 similar to the first clamp arm 112 of the first clamp portion 104. The methods, apparatus, and articles of manufacture described herein are not limited in this regard.

When the first clamp portion 104 is abutting the body portion 102, the first spring 210 and the second spring 212 may be compressed. Accordingly, the first clamp portion 104 may be pressed and maintained against the body portion 102 by the forces of the first spring 210 and the second spring 212. When the first clamp portion 104 is moved or pulled away from the body portion 102, a portion of the first rod 120 and a portion of the second rod 121 are moved out of the first passage 140 and the second passage 141 to reduce the length of the first annular passage 204 and the second annular passage 206, respectively. Accordingly, the first spring 210 and the second spring 212 are further compressed in the first annular passage 204 and the second annular passage 206 to increase the forces in the first spring 210 and the second spring 212, respectively. The first clamp portion 104 may be further moved or pulled away from the body portion 102 until the first spring 210 and the second spring 212 are fully compressed, i.e., can no longer be compressed. Thus, the first clamp portion 104 may be moved to any position from an initial position where the first clamp portion 104 is pressed against the body portion 102 and the springs 210 and 212 are compressed to a final position where the first spring 210 and the second spring 212 are fully compressed. The forces of the first spring 210 and the second spring 212 return the first clamp portion 104 to the initial position from any position between the initial position and the final position. The initial position of the first clamp portion 104 may define the smallest distance between the first clamp arm 112 and the second and third clamp arms 250 and 252. The final position of the first clamp portion 104 may define the largest distance between the first clamp arm 112 and the second and third clamp arms 250 and 252.

According to another embodiment, when the first clamp portion 104 is abutting the body portion 102, i.e., the initial position, the first spring 210 and the second spring 212 may be expanded. The springs 210 and 212 may be positioned in the first rod passage 140 and the second rod passage 141 between the second end portion 106 and the stops 220 and 222, respectively (not shown). The springs 210 and 212 are further expanded when the first clamp portion 104 is moved to any position from the initial position to the final position. The final position of the first clamp portion 104 may correspond to a position where the stops 220 and 222 contact the first end portion 104 (not shown).

The portable electronic device holder 100 can hold a portable electronic device between the first clamp arm 112 and the second and third clamp arms 250 and 252 by the clamp arms 112, 250 and 252 pressing on opposing surfaces, portions or sides of the portable electronic device with the forces of the first spring 210 and the second spring 212. Referring to FIGS. 6 and 7, a first inner surface 113 of the first clamp arm 112 may define an acute angle 127 with the direction of the forces exerted on the first clamp portion 104 by the springs 210 and 212. In FIGS. 6 and 7, the forces exerted on the first clamp portion 104 by the springs are shown to be generally in the same direction as the longitudinal axis 123 of the first rod 120 and/or the longitudinal axis 125 of the second rod 121. In other words, the first inner surface 113 is downwardly inclined relative to the body portion 102. Similarly, the second inner surface 117 of the second clamp arm 250 and the third inner surface 119 of the third clamp arm 252 may define an acute angle 129 with the longitudinal axis 123 and/or the longitudinal axis 125. In other words, the second inner surface 117 and the third inner surface 119 are upwardly inclined relative to the body portion 102. When the portable electronic device 1000 is pressed by the first inner surface 113, the second inner surface 117 and the third inner surface 119, the acute angles 127 and 129 cause a component of force to be exerted on the portable electronic device 1000 in a direction toward the body portion 102. Thus, as the first clamp arm 112 and the second and third clamp arms 250 and 252 press on opposing surfaces, portions or sides of the portable electronic device 1000, the portable electronic device may be pushed and/or maintained against the front surface 130 of the body portion 102.

Portable electronic devices of varying sizes may be held by the portable electronic device holder 100 by moving the first clamp portion 104 between the initial position and the final position to increase or decrease the distance between the first clamp arm 112 and the second and third clamp arms 250 and 252. For example, referring to FIG. 10, a rectangular portable electronic device 1000 may be held by the first clamp arm 112 and the second and third clamp arms 250 and 252 pressing against two opposing sides 1002 and 1004 of the portable electronic device 1000. Alternatively, the portable electronic device 1000 may be held by the first clamp arm 112 and the second and third clamp arms 250 and 252 pressing against the two opposing sides 1006 and 1008 of the portable electronic device 1000 (not shown). In another example, a circular portable electronic device (not shown) may be held with the portable electronic device holder 100 by the first clamp arm 112 and the second and third clamp arms 250 and 252 engaging radially opposing perimeter edges, surfaces and/or portions of the circular electronic device. Accordingly, a portable electronic device having any shape may be held by the portable electronic device holder 100 as long as two opposing sides, surfaces and/or portions of the portable electronic device can be engaged and held by the first clamp arm 112 and the second and third clamp arms 250 and 252.

A portable electronic device 1000 may be mounted on to the portable electronic device holder 100 by pulling the first clamp portion 104 away from the body portion 102 until the distance between the first lip portion 114 and the second and third lip portions 254 and 256 is greater than a distance between two opposing edges, surfaces and/or portions of the portable electronic device. The portable electronic device 1000 may then be inserted into the portable electronic device holder 100 by the back portion 1012 being moved toward the front surface 130 until the back portion 1012 abuts the front surface 130 and the bottom portion 1002 rests on the second and third clamp arms 250 and 252. The first clamp arm 112 may then be released or moved toward the body portion 102 so that the first clamp arm 112 engages the second side 1004 of the portable electronic device. Alternatively, the first clamp portion 104 may be pulled away from the body portion 102 until the distance between the first clamp arm 112 and the second and third clamp arms 250 and 252 is greater than a distance between two opposing edges, surfaces and/or portions of the portable electronic device 1000. The portable electronic device 1000 may then be inserted into the portable electronic device holder 100 by being slipped in-between the first clamp arm 112 and the second and third clamp arms 250 and 252 (i.e., the back portion 1012 being moved generally parallel to the front surface 130) and the bottom portion 1002 being rested on the second and third clamp arms 250 and 252. The first clamp arm 112 may then be released or moved toward the body portion 102 so that the first clamp arm 112 engages the top portion 1004 of the portable electronic device.

The forces generated by the compression of the first spring 210 and the second spring 212 cause the first clamp arm 112 and the second and third clamp arms 252 and 254 to press against the portable electronic device 1000 and frictionally hold the portable electronic device 1000 in the portable electronic device holder 100. The first clamp arm 112 and/or the second and third clamp arms 250 and 252 may include a frictional material and/or surface texture that may enhance the frictional engagement between the clamp arms 112, 250 and 252 and the portable electronic device 1000. For example, each of the clamp arms 112, 250 and 252 may include a rubber or high density foam pad that engages the portable electronic device 1000. According to another example, the portion of each of the clamp arms 112, 250 and 252 that engages the portable electronic device 1000 may have a certain texture that enhances the frictional engagement with the portable electronic device 1000.

The first lip portion 114 and the second and third lip portions 254 and 256 may engage a front surface or the display portion 1010 of the portable electronic device 1000 to further assist in holding the portable electronic device 1000 in the portable electronic device holder 100. To remove the portable electronic device 1000 from the portable electronic device holder 100, the first clamp portion 104 may be moved or pulled away from the body portion 102 so that the first clamp arm 112 is sufficiently spaced from the first side 1002 of the portable electronic device 1000 to allow removal of the portable electronic device 1000 from the portable electronic device holder 100.

The portable electronic device holder 100 may be mounted on a shaft of sports equipment or any cylindrical object. Referring to FIGS. 2-5, 7 and 10, the portable electronic device holder 100 may be mounted on a golf club shaft 800. The portable electronic device holder 100 may engage the golf club shaft 800 at any location on the golf club shaft 800. The curved channel 132 of the body portion 102 is located opposite to the front surface 130. Additionally, the curved channel 116 of the first clamp portion 104 may be linearly aligned with the curved channel 132 of the body portion 102. The curved channels 132 and 116 collectively define an elongated substantially linear channel having a concave curvature relative to the front surface 130. Furthermore, the length of the channel defined by the curved channel 132 and the curved channel 116 can increase or decrease based on the position of the first clamp portion 104 relative to the body portion 102. The curved channels 132 and 116 can receive a longitudinal portion of a shaft such as a golf club shaft 800. The channels 132 and 116 may be tapered from the first clamp portion 104 to the second end portion 106 to generally correspond to a taper in the golf club shaft 800. For example, the diameter of the golf club shaft 800 may decrease from the grip portion (not shown) to the head portion (not shown). Accordingly, the diameter or width of the channels 132 and 116 may decrease from the first clamp portion 104 to the second end portion 106. The channels 132 and 116 may have any dimensional variation from the first clamp portion 104 to the second end portion 106 to correspond to a similar dimensional variation in the golf club shaft 800. Although the channels 132 and 116 are described and shown as curved channels, the channels 132 and 116 may have any shape that corresponds to the shape of a certain shaft. For example, the channels 132 and 116 may have an oval shape to receive a shaft having an oval cross section. In another example, the channels 132 and 116 may have a triangular shape to receive a shaft having a triangular shape. The methods, apparatus, and articles of manufacture described herein are not limited in this regard.

Figure 4:
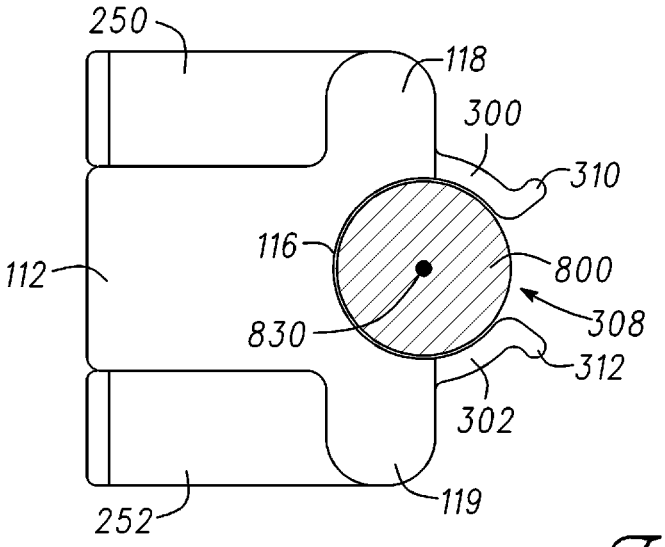
FIG. 4 shows a top view of the portable electronic device holder of FIG. 1.

Referring to FIGS. 2-7, the portable electronic device holder 100 may further include at least a pair of arms 300 and 302 that are spaced apart and disposed on opposite sides of the channel 132. The arms 300 and 302 and the curved channel 132 may collectively define a generally cylindrical passage 306 for receiving a portion of the golf club shaft 800 through an opening 308 that is defined by the space between the arms 300 and 302. According to one example, the arms 300 and 302 may be shaped to substantially continue the curvature of the curved channel 132. For example, as shown in FIGS. 4 and 5, if the cross section of the channel 132 defines a radial portion of a circle, then the arms 300 and 302 may define other radial portions of the same circle. Movement of the arms 300 and 302 from a rest position to widen or narrow the opening 308 can elastically bend the body portion 102, e.g., widen or narrow the channel 132. Accordingly, the elastic bending of the body portion 102 provides a biasing force for returning the arms 300 and 302 to the rest position. Alternatively, the arms 300 and 302 may be elastically flexible and/or be flexibly attached to the body portion 102. Each arm 300 and 302 may also include an expansion tab 310 and 312 that may extend along at least a portion of the arm 300 and 302, respectively. Each expansion tab 310 and 312 extends outwardly from the corresponding arm 300 and 302 to effectively enlarge the opening 308.

The generally transverse orientation of each expansion tab 310 and 312 relative to a corresponding direction of the arm 300 and 302, respectively, provides for the elastic bending of the arms 300 and 302, the channel 132 and/or the body portion 102 when a golf club shaft 800 is pressed against the expansion tabs 310 and 312. Accordingly, when a golf club shaft 800 is pressed against the expansion tabs 310 and 312, the golf club shaft 800 presses the expansion tabs 310 and 312 outward to elastically enlarge the opening 308 so that the golf club shaft 800 may be received in the cylindrical passage 306. Upon the golf club shaft 800 being inserted in the cylindrical passage 306, the elastic restoring force of the arms 300 and 302, the channel 132 and/or the body portion 102 move or snap the arms 300 and 302 back toward the pre-expanded position to frictionally engage the golf club shaft 800 in cooperation with the curved channel 132. The curved channel 132 and or the arms 300 and 302 may collectively define a partial oval cross-sectional shape, circular cross-sectional shape, rectangular cross-sectional shape, or any other shape that may be similar to correspondingly shaped shaft. The methods, apparatus, and articles of manufacture described herein are not limited in this regard.

A portable electronic device may be mounted on the golf club shaft 800 with the portable electronic device holder 100 to capture still and/or video images of an area around the portable electronic device; measure and/or determine relative and/or absolute linear motion, velocity and/or acceleration of the portable electronic device; measure and/or determine relative and/or absolute angular motion, velocity and/or acceleration of the portable electronic device; and/or measure and/or determine relative and/or absolute position of the portable electronic device. Referring to FIGS. 4, 5 and 7, the curved channel 132 and the curved channel 116 allow the axis 830 of the golf club shaft 800 to be located close to the front surface 130 of the portable electronic device holder 100, hence close to the portable electronic device 1000 when the portable electronic device 1000 is attached to the golf club shaft 800 with the portable electronic device holder 100. Accordingly, any of the above-described motion, velocity, acceleration and/or position measurements and/or determinations associated with the portable electronic device 1000 may be interpreted as motion, velocity, acceleration and/or position measurements and/or determinations associated with the golf club shaft 800. The distance 330 (shown in FIG. 1) between the bottom of the curved channel 132 and the front surface 130 (i.e., the smallest thickness of the material between the front surface 130 and the lowest point on the curved channel 132) may be optimally minimized based on the materials and/or methods of construction of the portable electronic device holder 100. For example, for a device holder constructed from a highly rigid material such as titanium, the distance may be smaller than a device holder constructed from a less rigid material such as plastic. Thus, the size and curvature of the curved channel 132 and the distance 330 may be optimally determined to place the axis 830 of the golf club shaft 800 as close as possible to the portable electronic device 1000.

Figure 11:
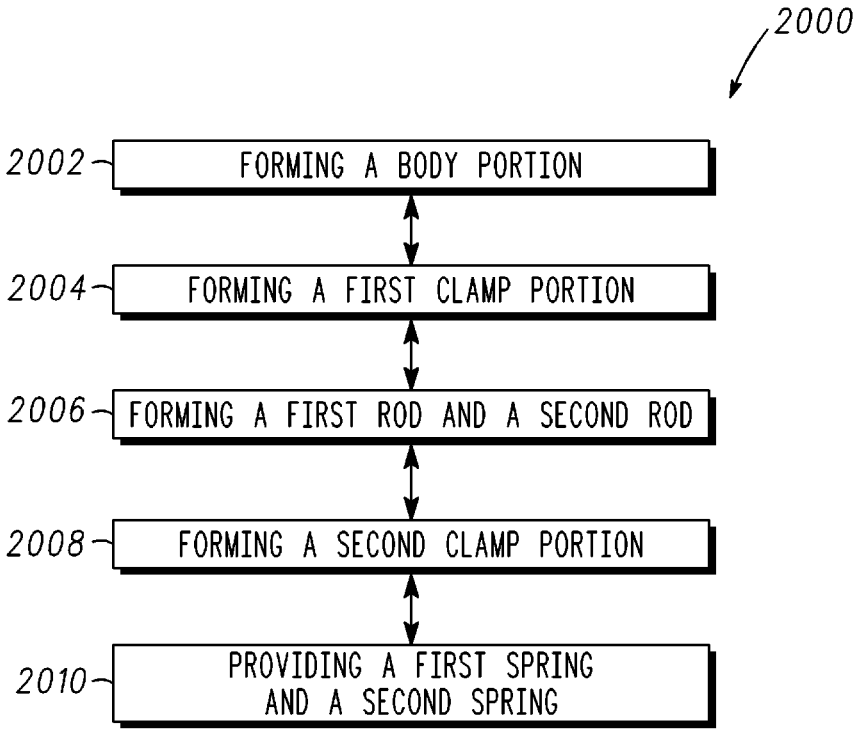
FIG. 11 shows a method of manufacturing a portable electronic device holder according to one embodiment.

Referring to FIG. 11, a method 2000 of manufacturing an exemplary portable electronic device holder 100 is shown. The method 2000 may include forming a body portion 102 (block 2002), forming a first clamp portion 104 (block 2004), forming a first rod 120 and a second rod 121 (block 2006), forming a second clamp portion 106 (block 2008), and providing a first spring 210 and a second spring 212 (block 2010). The second clamp portion 106 may be formed with the body portion 102 as a single unit. The springs 210 and/or 212 may be formed by any of the processes described herein. Additionally, the first rod 120 and the second rod 121 may be formed together with the first clamp portion 104.

Any single part or multiple parts of the portable electronic device holder 100 may be constructed from any type of material, such as stainless steel, aluminum, titanium, various metals or metal alloys, composite materials (e.g., Kevlar®, graphite and/or fiberglass), natural materials such as wood or stone or artificial materials such as plastic. Any single part or multiple parts of the portable electronic device holder 100, such as the body portion 102, the first and second rods 120 and 121, the springs 210 and 212, the first clamp portion 104 and/or the springs 210 and 212 may be constructed by stamping (i.e., punching using a machine press or a stamping press, blanking, embossing, bending, flanging, coining, or casting), injection molding, forging, machining or a combination thereof, or other processes used for manufacturing metal, composite, plastic or wood parts. The first and second springs 210 and 212 may be coil springs, leaf springs, radial springs, elastomer springs (e.g., annular or cylindrical elastomeric parts) or be constructed with any material and/or have any shape to provide the functions described herein. For example, the body portion 102 including the second clamp portion 106, the first and second rods 120 and 121 and the first clamp portion 104 may be constructed from plastic by an injection molding process. The springs 210 and 212 for example may be steel or plastic coil springs. The body portion 102 including the second clamp portion 106, the first and second rods 120 and 121, the springs 210 and 212 and the first clamp portion 104 may then be assembled to form the portable electronic device holder 100. The body portion 102 or any other part of the portable electronic device holder 100 may be constructed in multiple sections that may be joined together during assembly of the portable electronic device holder 100. For example, the body portion 102 may be constructed as two halves that are joined together during assembly of the portable electronic device holder 100.

The above examples are described in connection with a golf club such as a putter-type golf club, a driver-type golf club, a fairway wood-type golf club, a hybrid-type golf club, an iron-type golf club, or a wedge-type golf club. However, the apparatus and articles of manufacture described herein may be applicable other types of sports equipment such as a hockey stick, a tennis racket, a fishing pole, a ski pole, etc.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

Although certain example methods, apparatus, systems, and articles of manufacture have been described herein, the scope of coverage of this disclosure is not limited thereto. On the contrary, this disclosure covers all methods, apparatus, systems, and articles of manufacture fairly falling within the scope of the appended claims either literally or under the doctrine of equivalents.

What is claimed is:

1. A portable electronic device holder for a golf club comprising:

a body portion comprising a first end portion, a second end portion opposite to the first end portion, a front face extending between the first end portion and the second end portion, and a back face extending between the first end portion and the second end portion, the back face comprising a curved channel extending from the first end portion to the second end portion in a direction along an axis of a golf club shaft and configured to receive a portion of the golf club shaft, a distance between a bottom of the curved channel and the front face being less than a distance between the front face and the back face;

a clamp portion comprising a first clamp arm extending transverse to the body and a first lip portion operatively coupled to the body portion and a second clamp portion comprising another clamp arm extending transverse to the body and a second lip portion connected to the second end portion of the body portion, the first clamp portion being moveable relative to the first end portion of the body portion to change a distance between the first clamp portion and the second clamp portion;

a spring configured to connect the first clamp portion to the body portion and bias the first clamp portion toward the first end portion of the body portion such that the first clamp portion and the second clamp portion are configured to engage a portable electronic device and hold the portable electronic device on or proximate to the front face of the body portion between the first clamp portion and the second clamp portion; and, a first arm on one side of the curved channel, at least a portion of the first arm located outside of the curved channel and extending from the back face in a direction from the front face to the back face and a second arm on an opposite side of the curved channel, at least a portion of the second arm located outside of the curved channel and extending from the back face in a direction from the front face to the back face, wherein when a portion of the golf club shaft is received in the curved channel, the first arm, the second arm and a portion of the curved channel between the first arm and the second arm engage the portion of the golf club shaft to hold the golf club shaft between the first arm, the second arm and the curved channel.

2. A portable electronic device holder as defined in claim 1, wherein the curved channel is convex relative to the front face.

3. A portable electronic device holder as defined in claim 1, wherein the first clamp portion comprises a curved channel extending in a same direction as the curved channel of the body portion and configured to receive a portion of the golf club shaft.

4. A portable electronic device holder as defined in claim 1, wherein the first and second arms are elastic relative to the body portion.

5. A portable electronic device holder as defined in claim 1, wherein the first and second arms are curved to generally continue a curvature of the curved channel on a corresponding side of the curved channel.

6. A portable electronic device holder as defined in claim 1, wherein the body portion further comprises a passage extending between the first end portion and the second end portion, wherein the first clamp portion comprises a rod configured to at least partially traverse through the passage, and wherein the spring is located between the rod and the passage and is compressed when the first clamp portion is moved away from the first end portion of the body portion.

7. A portable electronic device holder as defined in claim 1, wherein the first clamp portion is moveable relative to the second clamp portion from a first position wherein the first clamp portion is spaced apart from the second clamp portion and the spring is compressed, to a second position wherein the first clamp portion is farther spaced apart from the second clamp portion and the spring is further compressed than in the first position.

8. A portable electronic device holder as defined in claim 1, wherein the clamp arm and another clamp arm are configured to engage opposing portions of a portable electronic device to hold the portable electronic device by a biasing force of the spring.

9. A portable electronic device holder for a golf club comprising:

a body portion comprising:

a first end portion, a second end portion opposite to the first end portion, a front face extending between the first end portion and the second end portion, the front face configured to receive at least a portion of a portable electronic device, a first passage extending between the first end portion and the second end portion;

a second passage extending between the first end portion and the second end portion, and a curved channel disposed substantially between the first passage and the second passage and extending in a direction from the first end portion to the second end portion, the curved channel having a convex curvature relative to the front face such that a portion of a golf club shaft is received inside the curved channel, a portion of the first passage, a portion of the second passage and a portion of the curved channel being aligned;

a clamp portion comprising a clamp arm extending transverse to the body portion, a first lip portion, and a first rod configured to at least partially traverse through the first passage and a second rod configured to at least partially traverse thorough the second passage;

a second clamp portion comprising another clamp arm extending transverse to the body portion and a second lip portion connected to the second end portion of the body portion;

a first spring disposed in the first passage and configured to operatively couple the first rod to the body portion;

a second spring disposed in the second passage and configured to operatively couple the second rod to the body portion; and wherein the first spring and the second spring are configured to bias the first clamp portion toward the first end portion of the body portion such that the first clamp portion and the second clamp portion are configured to engage a portable electronic device and hold the portable electronic device on or proximate to the front face of the body portion between the first clamp portion and the second clamp portion.

10. A portable electronic device holder as defined in claim 9, wherein the first clamp portion comprises a curved channel between the first rod and the second rod and extending in substantially the same direction as the curved channel of the body portion, and wherein the curved channel of the first clamp portion is configured to receive a curved portion of the golf club shaft.

11. A portable electronic device holder as defined in claim 9 further comprising:

a first arm on a first side of the curved channel and extending along at least a portion of the curved channel, the first arm being elastically movable relative to the body portion;

a second arm on a second side of the curved channel opposite to the first side of the curved channel and extending along at least a portion of the curved channel, the second arm being elastically movable relative to the body portion; and wherein when the golf club shaft is received in the curved channel, the first arm and the second arm engage a portion of the golf club shaft to hold the golf club shaft between the first arm and the second arm and the curved channel.

12. A portable electronic device holder as defined in claim 9 further comprising:

a first arm on a first side of the curved channel and extending along at least a portion of the curved channel, the first arm being elastically movable relative to the body portion;

a second arm on a second side of the curved channel opposite to the first side of the curved channel and extending along at least a portion of the curved channel, the second arm being elastically movable relative to the body portion; and wherein each arm is elastic relative to the body portion, and wherein the first and second arms are curved to generally continue a curvature of the curved channel on a corresponding side of the curved channel.

13. A portable electronic device holder as defined in claim 9, wherein the first clamp portion is moveable from a first position to a second position, wherein in the first position the first clamp portion is at a first distance relative to the second clamp portion, and the first spring and the second spring are compressed to bias the first clamp portion toward the body portion, and wherein in the second position, the first clamp portion is at a second distance that is greater than the first distance, and the first spring and the second spring are more compressed than in the first position of the first clamp portion to bias the first clamp portion toward the body portion.

14. A portable electronic device holder as defined in claim 9, wherein the first spring is bound in the first passage by the first end portion and an end of the first rod opposite to the first clamp portion, and wherein the second spring is bound in the second passage by the first end portion and an end of the second rod opposite to the first clamp portion.

15. A portable electronic device holder for a golf club comprising:

a body portion comprising a first end portion, a second end portion opposite to the first end portion, a front face extending between the first end portion and the second end portion, and a back face extending between the first end portion and the second end portion, the back face comprising a curved channel extending from the first end portion to the second end portion in a direction along an axis of a golf club shaft and configured to receive a portion of the golf club shaft;

a clamp portion comprising a clamp arm extending transverse to the body and a first lip portion operatively coupled to the body portion and a second clamp portion comprising another clamp arm extending transverse to the body and a second lip portion connected to the second end portion of the body portion, the first clamp portion being moveable relative to the first end portion of the body portion to change a distance between the first clamp portion and the second clamp portion;

a spring configured to connect the first clamp portion to the body portion and bias the first clamp portion toward the first end portion of the body portion such that the first clamp portion and the second clamp portion are configured to engage a portable electronic device and hold the portable electronic device on or proximate to the front face of the body portion between the first clamp portion and the second clamp portion;

a first arm fixedly attached to the body portion on one side of the curved channel and extending from the body portion and a second arm separate from the first arm and fixedly attached to the body portion on an opposite side of the curved channel and extending from the body portion, wherein when a portion of the golf club shaft is received in the curved channel, the first arm and the second arm engage the portion of the golf club shaft to hold the golf club shaft between the first arm, the second arm and the curved channel; and wherein a length of the first and second arm in a direction extending from the first end portion to the second end portion is less than a length of the curved portion extending in the direction from the first end portion to the second end portion.

16. A portable electronic device holder as defined in claim 15, wherein the first clamp portion comprises a curved channel extending in a same direction as the curved channel of the body portion and configured to receive a portion of the golf club shaft.

17. A portable electronic device holder as defined in claim 15, wherein the first and second arms are curved to generally continue a curvature of the curved channel on a corresponding side of the curved channel.

18. A portable electronic device holder as defined in claim 15, wherein the body portion further comprises a passage extending between the first end portion and the second end portion, wherein the first clamp portion comprises a rod configured to at least partially traverse through the passage, and wherein the spring is located between the rod and the passage and is compressed when the first clamp portion is moved away from the first end portion of the body portion.

19. A portable electronic device holder as defined in claim 15, wherein the first clamp portion is moveable relative to the second clamp portion from a first position wherein the first clamp portion is spaced apart from the second clamp portion and the spring is compressed, to a second position wherein the first clamp portion is farther spaced apart from the second clamp portion and the spring is further compressed than in the first position.

20. A portable electronic device holder as defined in claim 15, wherein the clamp arm and another clamp arm are configured to engage opposing portions of a portable electronic device to hold the portable electronic device by the biasing force of the spring.

* * * * *